United States Patent [19]

Morpeau

[11] Patent Number: 4,795,164

[45] Date of Patent: Jan. 3, 1989

[54] DRIBBLE PRACTICE DEVICE FOR SOCCER PLAYERS AND THE LIKE

[76] Inventor: William A. Morpeau, 216-14 113th Dr., Queens Village, N.Y. 11429

[21] Appl. No.: 152,370

[22] Filed: Feb. 4, 1988

[51] Int. Cl.[4] ..... A63B 69/00

[52] U.S. Cl. ..... 273/411; 273/110

[58] Field of Search ..... 273/411, 413, 110

[56] References Cited

U.S. PATENT DOCUMENTS

| | | | |
|---|---|---|---|
| 4,089,526 | 5/1978 | Olving | 273/110 |
| 4,158,458 | 6/1979 | Gomez | 273/413 |
| 4,166,327 | 9/1979 | Wressell | 273/110 X |
| 4,477,083 | 10/1984 | Sowards | 273/411 |
| 4,478,420 | 10/1984 | Sowards | 274/411 |
| 4,512,578 | 4/1985 | Dalton | 273/110 |

*Primary Examiner*—William H. Grieb

*Attorney, Agent, or Firm*—Richard L. Miller

[57] ABSTRACT

This dribble practice device is designed to aid in increasing a soccer player's skill and coordination when not on the field. Primarily, it consists of a base frame mounting a vertical bar with a swivel mounted tray on top which receives a mini ball that is designed to roll smoothly around in the tray when the device is operated by a user. The device also is provided with a pair of foot operated control bars connected by cords or wires to the tray and the cords or wires are strung through eyes mounted to the device.

6 Claims, 1 Drawing Sheet

FIG. 1
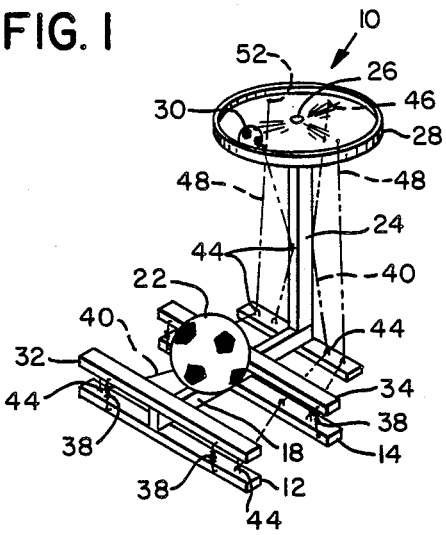
FIG. 2
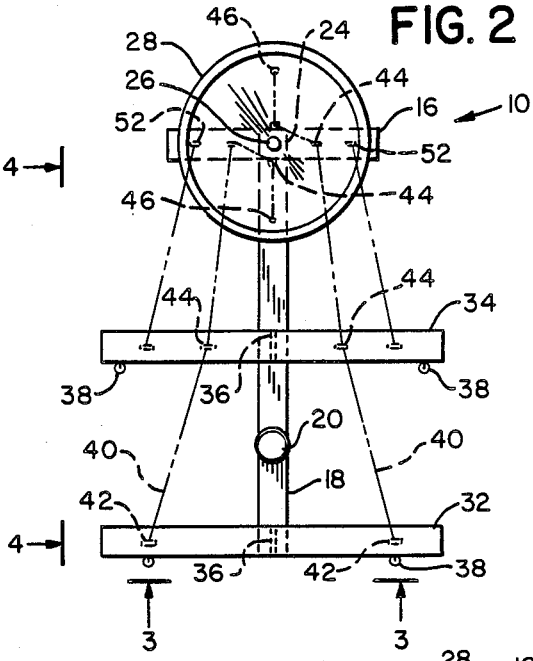
FIG. 4
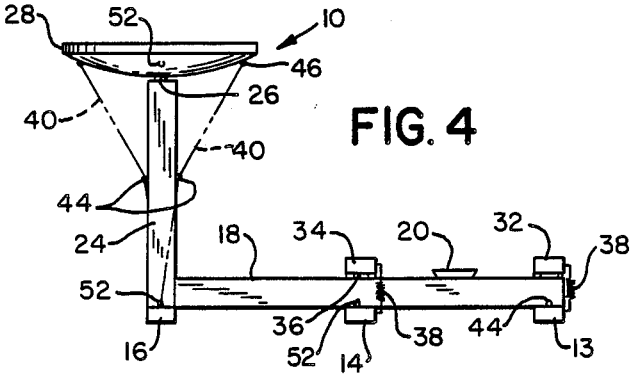
FIG. 3
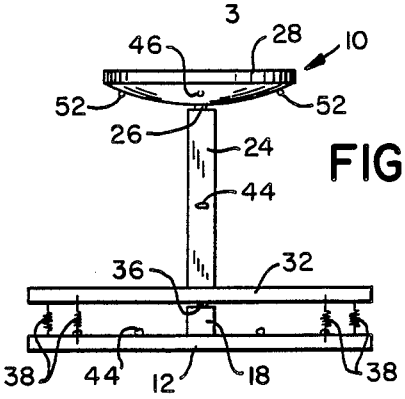
FIG. 5
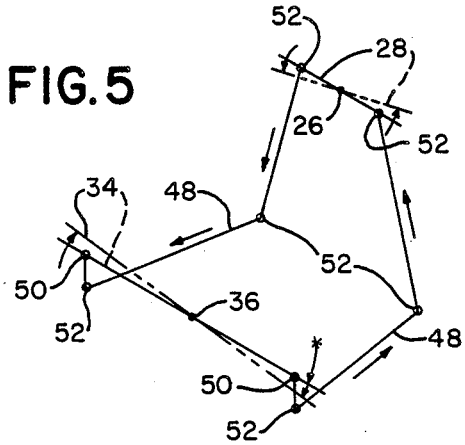
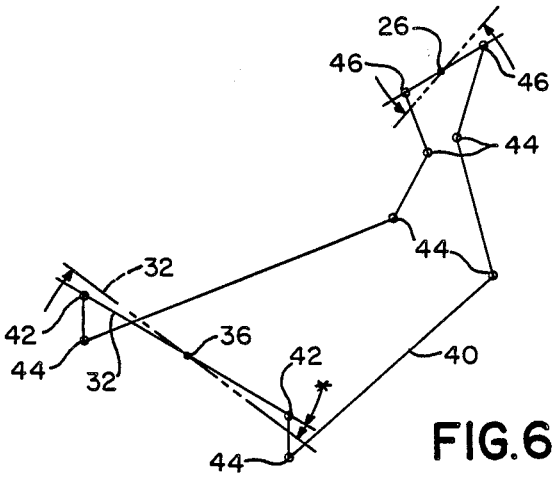
FIG. 6

DRIBBLE PRACTICE DEVICE FOR SOCCER PLAYERS AND THE LIKE

BACKGROUND OF THE INVENTION

The instant invention relates generally to devices for developing and improving one's coordination, and more particularly, to a dribble practice device for soccer players and the like.

Numerous devices have been provided in the prior art that are adapted to improve one's coordination in sports. While these units may be suitable for the particular purpose to which they address, they would not be as suitable for the purpose of the present invention as hereafter described.

SUMMARY OF THE INVENTION

A primary object of the present invention is to provide a dribble practice device that will overcome the shortcomings of the prior art devices.

Another object is to provide a dribble practice device that will be so designed, as to improve one's skill and coordination in the game of soccer or the like.

An additional object is to provide a dribble practice device that will be so designed, as to have levers and lines for the control of an upper pan having a ball therein.

A further object is to provide a dribble practice device that is simple and easy to use.

A still further object is to provide a dribble practice device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a perspective view of the instant invention, showing control lines in phantom;

FIG. 2 is a top plan view thereof, with the ball removed therefrom;

FIG. 3 is a fragmentary elevational view, taken along line 3—3 of FIG. 2;

FIG. 4 is another fragmentary elevational view, taken along line 4—4 of FIG. 2;

FIG. 5 is a diagrammatic perspective view illustrating the left-right tilting action; and FIG. 6 is a diagrammatic perspective view illustrating the forward-back tilting action.

DETAILED DESCRIPTION OF THE PREFERRED EMBODIMENTS

Turning now descriptively to the drawings, in which like reference characters denote like elements throughout the several views, a dribble practice device 10 is shown to include a frame composed of three parallel spaced base bars 12, 14, and 16. A longitudinal bar 18 is fixedly secured to the top of base bars 12 and 14, and a shallow cup 20 is fixedly secured to the top of bar 18 and removably receives a standard size soccer ball 22.

Bar 18 is centrally disposed on top of bars 12 and 14, and is fixedly secured at one end, to a bottom portion of a vertical bar 24.

The upper end of bar 24 is provided with a swivel 26 attached to the center of a rimmed and circular tray 28 that receives a rolling mini ball 30 designed to travel smoothly around the top surface of the rimmed tray 28.

A front control lever bar 32 is centrally disposed above bar 18, as is a second control lever bar 34, and hinges 36 are fixedly secured to the top of bar 18 and to the bottoms of control lever bars 32 and 34, enabling bars 32 and 34 to pivot upward and downward left and right. A coil spring 38 is secured to end portions of control lever bars 32 and 34, and base bars 13 and 14, so as to return both 32 and 34 to their normal horizontal positions.

A pair of lines 40 are secured fast at one end to a pair of eyes 42 mounted to the bottom of first control lever 32 near its ends, and lines 40 are freely received through eyes 44 mounted to the top of base bar 12, base bar 14, and base bar 16. Lines 40 are further freely received through eyes 44 secured to the top of bar 16, the front and rear of vertical bar 24, and are secured fast in eyes 46 fixedly secured to the bottom of tray 28, and eyes 46 are spaced apart and align with the longitudinal length of bar 18, the arrangement being such, that when the front control lever bar 32 is pivoted left and right, the tray 28 will tilt forwardly and rearwardly.

A pair of lines 48 are secured fast at one end to a pair of eyes 50 secured to the bottom of second control lever 34, and are freely received through eyes 52 secured to the top of bar 14 and bar 16, and the other ends of lines 48 are secured fast to eyes 52 that are fixedly secured to the bottom of tray 28. The eyes 52 are spaced apart and are at right angles to the similar eyes 46 fixedly secured to the bottom of tray 28, enabling left and right pivoting of tray 28 when second control lever 34 is pivoted downward left and right.

In use, the operator through his feet urges downward alternately left and right of the end portions of the first control lever 32 and the second control lever 34, and by coordination of his foot movement on first control lever 32 and second control lever 34, the result will cause mini ball 30 to rotate smoothly around the tray 28 as tray 28 is pivoted front to rear and laterally downward left and right.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A dribble practice device, comprising, a frame composed of three parallel spaced base bars, a longitudinal bar and a vertical bar secured to said base bars for cooperating with a pivotal first control lever and a spaced and pivotal second control lever mounted to said longitudinal bar, for controlling said device, and a pivotal tray mounted to said vertical bar and removably receiving a mini ball that is provided for indicating coordination of foot movements of an operator of said device.

2. A dribble practice device as set forth in claim 1, wherein said first control lever is mounted by a hinge fixedly secured to a front end of a top of said longitudinal bar in alignment with a first base bar of said three parallel spaced bars, and said second control lever is mounted by a hinge fixedly secured to said top of said longitudinal bar in alignment with a second base bar of said three parallel spaced bars, and one end of a pair of coil springs are secured to end portions of said first control lever, and another end of said pair of coil springs are secured to end portions of said first base bar, providing equal upward return means for said first control lever to full horizontal position after operator foot pressure has been released from said end portions of said first control lever.

3. A dribble practice device as set forth in claim 2, wherein one end of a second pair of coil springs are secured to end portions of said second control lever, and another end of said second pair of coil springs are secured to end portions of said second base bar, providing equal upward return means for said second control lever to horizontal position after said operator foot pressure has been released from end portions of said second control lever.

4. A dribble practice device as set forth in claim 3, wherein a pair of first lines are provided and one end of said pair of first lines are secured fixedly t eyes fixedly secured to bottom end portions of said first control lever, and said pair of first lines are freely received in similar eyes fixedly secured to end portions of a top of said first base bar, said second base bar, a third base bar of said three, eyes secured to a front and rear of said vertical bar, and eyes fixedly secured to a bottom surface of said pivotal tray in a front area of said device and a rear area of said device, and when said operator foot pressure is applied alternately to ends of said first control lever, said tray pivots towards said front area and said rear area of said device by means of said pair of first lines, causing said mini ball to roll in said tray.

5. A dribble practice device as set forth in claim 4, wherein a pair of second lines are provided and one end of said pair of second lines are secured fixedly to eyes fixedly secured to bottom end portions of said second control lever, and said pair of second lines are freely received in eyes fixedly secured to end portions of a top of said second base bar, said third base bar, and another pair of eyes fixedly secured to said bottom surface of said tray at the sides of said device, and when said operator foot pressure is applied alternately to ends of said second control lever, said tray pivots right and left by means of said second pair of lines and when said operator coordinates said foot pressure effectively, said mini ball is caused to rotate around a rim area of said tray.

6. A dribble practice device as set forth in claim 5, wherein a swivel is fixedly secured to a center of said bottom of said tray and is fixedly secured to a top of said vertical bar, and a shallow cup is fixedly secured to said longitudinal bar and removably receives a soccer ball.

* * * * *